United States Patent [19]

Berfield

[11] Patent Number: 4,563,789

[45] Date of Patent: Jan. 14, 1986

[54] HOSE END HOLDER

[75] Inventor: Robert C. Berfield, Jersey Shore, Pa.

[73] Assignee: Shop-Vac Corporation, Williamsport, Pa.

[21] Appl. No.: 602,174

[22] Filed: Apr. 19, 1984

[51] Int. Cl.[4] ..... A47L 9/00

[52] U.S. Cl. ..... 15/323; 15/339

[58] Field of Search ..... 15/323, 339, 410; 24/17 B, 20 CW, 335, 336; 248/75, 74.1, 52

[56] References Cited

U.S. PATENT DOCUMENTS

| | | | |
|---|---|---|---|
| 2,634,451 | 4/1953 | Dow | 15/410 X |
| 2,769,998 | 11/1956 | Hunter | 15/323 X |
| 2,859,007 | 11/1958 | Cooke | 248/75 |
| 2,873,999 | 2/1959 | Webb | 248/75 X |
| 3,747,166 | 7/1973 | Eross | 248/75 |
| 3,872,538 | 3/1975 | Crouser | 15/323 |

*Primary Examiner*—Chris K. Moore

*Attorney, Agent, or Firm*—Ostrolenk, Faber, Gerb & Soffen

[57] ABSTRACT

A hose end holder for an appliance, such as a vacuum cleaner. The hose is corrugated. The end of the hose proximal to the housing of the vacuum cleaner is supported on a nipple attached on the vacuum cleaner. A first tube is placed over the proximal end of the hose and on the nipple to secure the proximal end of the hose in place. The periphery of a second tube is held on the periphery of the first tube. The distal end of the hose is held in the second tube. The two tubes are preferably parallel. The hose is a tight fit on the nipple. The hose is further secured on the nipple by the first tube tightly fitting on the outside of the proximal end portion of the hose extending over the nipple. The first tube has a detent therein extending as a secant adjacent the inner circumference thereof and nesting between a pair of corrugations of the hose.

4 Claims, 3 Drawing Figures

HOSE END HOLDER

BACKGROUND OF THE INVENTION

The present invention relates to a retainer for the end of a hose, in particular a retainer for the end of a flexible hose, and particularly a hose utilized in connection with appliances such as a vacuum cleaner. Although the invention is described in conjunction with a vacuum cleaner, its use is not limited to this environment.

Vacuum cleaners of the tank or canister type utilize a flexible hose connected to the tank at one end of the hose and having, at its other end, a means for mounting and securing various attachments and devices which will make the utilization of the vacuum cleaner and the hose attached thereto more efficient.

There is a problem of storing the hose. One solution is to make the end of the hose at the vacuum cleaner tank readily attachable and removable so that the hose may be removed from the tank for storage. The separable hose leads to additional storage problems. This is true especially with large vacuum cleaners. As a result, it has frequently become desirable to attach the hose to the tank of the vacuum cleaner, or to the other device, so that it remains associated with the tank. It then becomes desirable to provide means for anchoring the free end of the hose so that the hose will be neatly stored with the tank and not hang loose and become subject to abrasion or damage. Furthermore, when the hose is to be stored separately from the tank, it also should be able to be stored neatly with its free end anchored.

Various means have been provided for preventing the free end of a hose, and particularly the end remote from the tank from falling loose. Some of these means are shown in prior United States patents. In Kohtz, U.S. Pat. No. 2,799,907, the proximal end of the hose is screwed to a member supported by the tank and there are means for removably retaining another portion of the hose. Clips of various kinds have been used, as in Elkins, U.S. Pat. No. 3,865,310, which fixes one end of the hose while the free end of the hose is removably clipped in place. Spring tubes have been used, as shown in Eross, U.S. Pat. No. 3,747,166, which serve to receive the hose at two points to permit the hose to slide with respect to the holding means. Also see Beck, U.S. Pat. No. 4,407,472 and Boas, U.S. Pat. No. 351,951 which provides two loops for holding the hose. Also note Schaefer, U.S. Pat. No. 3,480,987 which provides a holder for the hose.

SUMMARY OF THE INVENTION

An object of the present invention is to find a solution to the problem of hose storage.

Another object of the invention is to hold the proximal end of the hose to a fixture on the tank, or the like, on which the hose is attached.

A further object is to provide a holder for the distal end of the hose, and more particularly for holding it in the vicinity of the proximal end of the hose.

Yet another object of the invention is to secure the holder and the hose against axial movement, even while permitting relative rotational movement.

According to the invention, the proximal end of a hose is connected to the tank of a vacuum cleaner, or to any other object with which the hose is used, in such manner that, in effect, the hose may be held on a fitting on the tank. The opposite distal end of the hose is held in a support in the shape of a tube, which support is associated with the means for securing the hose to the tank. The invention is not limited to use for a hose attached to a tank or other housing. It also applies to a hose which is freely hanging or free of any support.

In the invention, a single support structure is provided for supporting the proximal end of the hose and for receiving the distal end of the hose. The single structure comprises a pair of tubular members secured together and in which one of the tubular members is secured at the proximal end portion of the hose and the other tubular member is a support mounted to the first tubular member and arranged to receive the distal end of the hose. The two tubular members are preferably parallel.

The hose may be secured at its proximal end portion over a nipple extending from the tank and may also be at least partially compressed onto the nipple by the first tubular member. A detent is located inside, and particularly on the inner circumference of, the first tubular member for preventing axial movement of the first tubular member with respect to the hose and also for keeping the hose secured to the nipple due to the action of the first tubular member.

The foregoing and other objects of the present invention will become apparent from the following description of the accompanying drawings.

DETAILED DESCRIPTION OF THE PREFERRED EMBODIMENT

Figure 1:
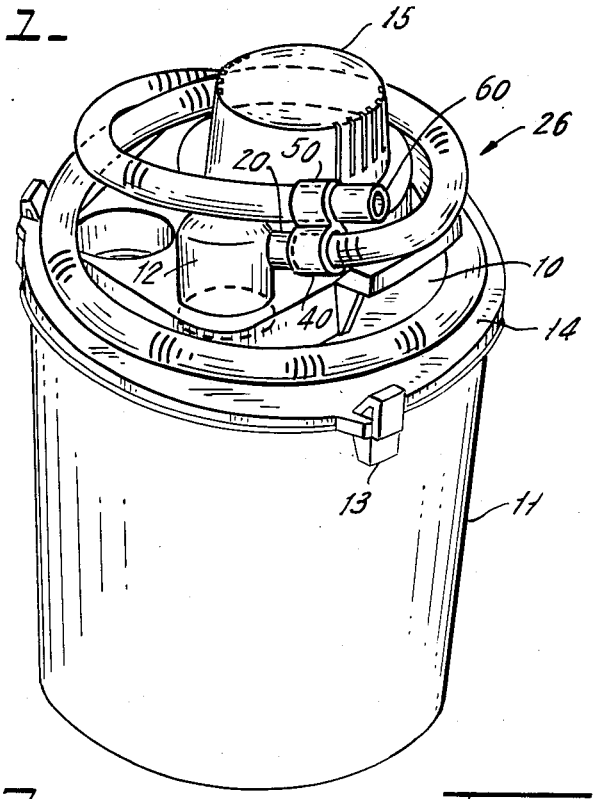
FIG. 1 is a view in perspective showing a vacuum cleaner tank having the hose connection and support at the top thereof in accordance with the present invention.
Figure 2:
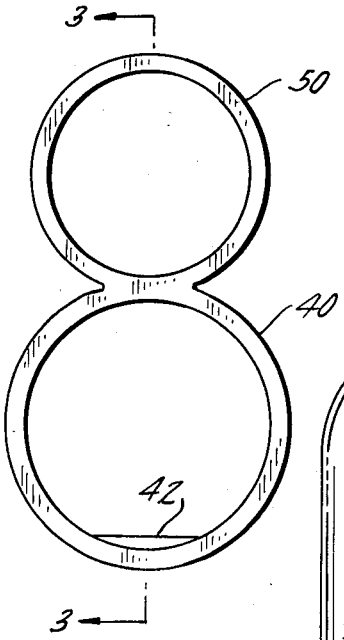
FIG. 2 is an end view taken on line 2—2 of FIG. 3, looking in the direction of the arrows, with the hose removed from the support offered by the tank of FIG. 1.

In the drawing, the placement of the hose on a tank is shown. But, the invention can be used without having the hose on any other object.

Referring to the drawings, the cover 10 of the vacuum cleaner tank 11 is provided with a nipple structure 20), which is hereinafter more fully described. The cover 10 is secured on the tank 11 in any suitable manner as by the snap overcenter fasteners 13 which are spaced around the periphery of the rim 14 of the cover. The cover 10 is provided with elements appropriate to the vacuum cleaner including the motor housing 15 which supports the vacuum cleaner blow motor and fan and other elements, all in a manner known in the art.

Figure 3:
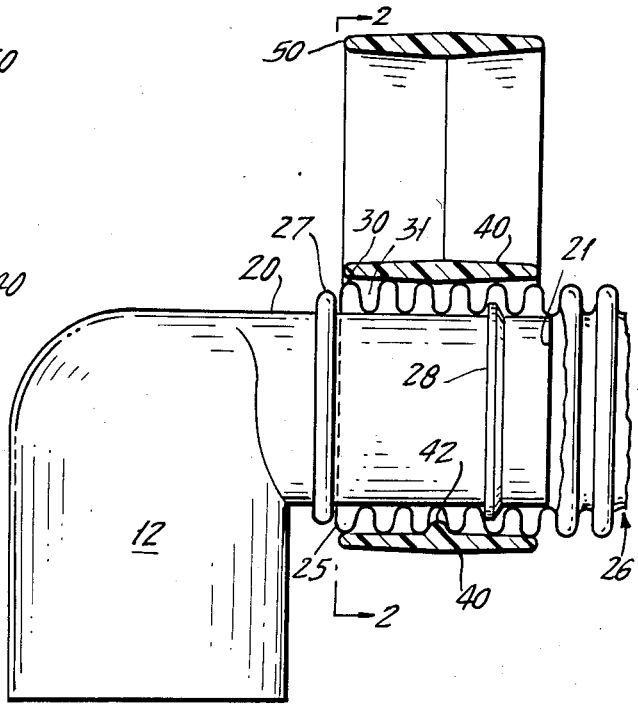
FIG. 3 is a cross-sectional view taken on line 3—3 of FIG. 2, looking in the direction of the arrows, showing the proximal end of the hose mounted on the tank by means of the hose connection of FIG. 2.

The cover 10 carries the upstanding connector or conduit 12 which has an appropriate longitudinal opening enter the tank 11 below the cover 10. The connector 12 is also connected at an elbow to the nipple 20. The nipple 20 has an opening therein extending laterally in FIG. 3 to the end 21 thereof. The nipple is so arranged and sized as to receive the proximal end 25 of the hose 26 and to retain the hose thereon. The nipple 20 has a proximal, annular, external flange 27 so that the proximal end 25 of the hose may bear against the flange and provide a means for determining by feel, as well as by sight, that the hose is properly placed on the nipple. The nipple 20 may have additional annular, external flanges 28 to frictionally or otherwise engage the material at the interior of the hose 26.

The hose 26 is a flexible corrugated hose having a series of parallel circular corrugations 30 separated by troughs 31. This corrugated arrangement permits the hose to be bent as desired.

The hose is held in place not only by the flanges 28 but also because it is a good fit on the nipple 20. Further, the tubular member 40, which is a reasonably tight fit on the end of the hose 26, frictionally positions the hose end with respect to the nipple 20. The tube 40 should have a cross-sectional shape that permits it to be supported by the nipple 20 and in good air-tight securement therewith. Consequently, the tube 40 must be of an appropriate shape to match the end of the hose. Thus, the shape of the proximal end of the hose and tube is preferably of circular cross-section.

In addition, the flange 28 on the nipple 20 serves by engaging at least one of the corrugations on the inside of the hose, to provide a lock for the hose against longitudinal movement. Owing to the flexibility of the material of the hose, this lock may be defeated by the imposition of sufficient force longitudinally of the axis of the opening in the nipple and in the hose. In addition, therefore, the tubular member 40, which is a reasonably tight fit on the end of the hose on the nipple 20, is provided with the internal detent 42 comprising a secant extension adjacent the outer circumference and normal to the axis of the tube and the nipple. This detent 42 engages in one of the corrugation troughs 31.

With the above described holding of the hose against longitudinal movement, the hose end may be rotated in place to the extent that the tightness of the tube 40 permits. Because the material of the hose is somewhat flexible, the imposition of sufficient longitudinal force on the hose may permit it to be removed in the rare instances where that is desired to permit replacement or repair of the hose.

The longitudinal tubular member or tube 40 has associated with it an additional tubular member or tube 50, which may be integral with the tube 40 and which, in the preferred embodiment, extends parallel to the tube 40. If the additional tube 50 is not integral with the tube 40, it must be secured thereto in a reasonably permanent fashion and desirably extends parallel to the tube 40, so that tubes 50 and 40 have parallel axes. However, it is possible under certain circumstances and depending on the length of the hose for the tubes 50 and 40 to extend with their axes at an angle to each other or even to be pivotable with respect to each other. The tube 50 is also preferably of circular cross-section especially where the distal end 60 of the tube 26 is of circular cross-section but the tube 50 may be of any other cross-section which is consistent with holding the end 60 of the hose 26, whatever the cross-sectional shape of the end 60 of the hose.

The essence of the structure is that the tube 40 provides means for securing the mounting of the proximal end of the hose on the nipple 20, and the tube 40 also carries the tube 50, which acts as a retainer for the free distal end 60 of the hose 26. This free end 60 may be inserted inside the tube 50 to be retained thereby. Because of the sharp curvature necessarily imposed on the hose in order to obtain the entry of the end 60 of the hose into the tube 50, the inherent elasticity of the hose and its tendency to straighten out will provide sufficient bias to anchor the end 60 of the hose 26 in the tube 50. The inner surface of the tube 50 may be appropriately shaped, treated, scored or ridged in order to provide additional frictional interengagement between the inner surface of the tube 50 and the end 60 of the hose.

Since the end 60 of the hose 26 is intended to be inserted into various appliances which are operated by or in connection with the tank 11 and the cover 10, the end 60 of the hose may be somewhat smaller in diameter than the proximal end of the hose which is positioned on the nipple 20. The tube 50 is correspondingly smaller in diameter than the tube 40.

In the foregoing, the present invention has been described in connection with a preferred illustrative embodiment thereof. Since many variations and modifications of the present invention will now be obvious to those skilled in the art, it is preferred that the scope of the present invention be determined not by the specific disclosures herein contained, but only by the appended claims.

I claim:

1. A hose end holder for holding a hose of a vacuum cleaner coiled upon itself, wherein the hose has a proximal end portion and has a distal end; a nipple; the proximal end portion of the hose being mounted over the nipple and being fitted thereon; a tubular member around the exterior of the proximal end portion of the hose and over the nipple for additionally securing the hose on the nipple; a detent inside the tubular member for engaging the hose inside the the tubular member and for preventing separation of the hose and the tubular member; the tubular member supporting a further hose support which is integral therewith and which is sized and shaped to surround and receive and retain the distal end of the hose, the further hose support having an axis substantially parallel to the axis of the tubular member and the nipple.

2. The holder of claim 1, wherein the hose is formed of a plurality of corrugations both internally and externally extending circumferentially of the hose.

3. The holder of claim 1, wherein the detent is adjacent the internal circumference of the tubular member.

4. In combination, the holder of claim 1 and a housing having an opening into it; the nipple extending into the housing opening and being supported there.

* * * * *